US008512476B2

(12) United States Patent
Kaneko et al.

(10) Patent No.: US 8,512,476 B2
(45) Date of Patent: Aug. 20, 2013

(54) ULTRASONIC CLEANING METHOD, AND ULTRASONIC CLEANING APPARATUS

(75) Inventors: Kimihisa Kaneko, Nagoya (JP); Kunihiko Yoshioka, Nagoya (JP); Minoru Imaeda, Ichinomiya (JP)

(73) Assignee: NGK Insulators, Ltd., Nagoya (JP)

( * ) Notice: Subject to any disclaimer, the term of this patent is extended or adjusted under 35 U.S.C. 154(b) by 525 days.

(21) Appl. No.: 12/716,479

(22) Filed: Mar. 3, 2010

(65) Prior Publication Data

US 2010/0224214 A1 Sep. 9, 2010

(30) Foreign Application Priority Data

Mar. 4, 2009 (JP) ..... 2009-50180

(51) Int. Cl.
*B08B 3/12* (2006.01)

(52) U.S. Cl.
USPC ..... 134/1; 134/18

(58) Field of Classification Search
USPC ..... 134/1, 184
See application file for complete search history.

(56) References Cited

U.S. PATENT DOCUMENTS

| | | | | |
|---|---|---|---|---|
| 6,551,409 | B1 * | 4/2003 | DeGendt et al. | 134/2 |
| 2004/0144399 | A1 * | 7/2004 | McDermott et al. | 134/1 |
| 2008/0156347 | A1 * | 7/2008 | Haibara et al. | 134/1.3 |
| 2008/0308132 | A1 | 12/2008 | Tomita et al. | |

FOREIGN PATENT DOCUMENTS

| | | | |
|---|---|---|---|
| JP | 06-320124 | A1 | 11/1994 |
| JP | 2006-055685 | A1 | 3/2006 |
| JP | 2007-253120 | A1 | 10/2007 |
| JP | 2007311756 | A * | 11/2007 |
| JP | 2008-119642 | A1 | 5/2008 |
| JP | 2008103701 | A * | 5/2008 |
| JP | 2008-300429 | A1 | 12/2008 |

OTHER PUBLICATIONS

Machine translation of JP2008-103701A to Shinbara.*
Abstract of JP2007-311756A to Goto.*

* cited by examiner

*Primary Examiner* — Michael Kornakov
*Assistant Examiner* — Douglas Lee
(74) *Attorney, Agent, or Firm* — Burr & Brown

(57) ABSTRACT

The frequency and power of ultrasonic waves is adjusted to materialize the relation $0.04f-20.0 \leqq P \leqq 0.09f-7.5$, wherein f (kHz) is the frequency of the ultrasonic waves and P (W/L) is the power per unit fluid volume obtained by dividing the power (W) of the ultrasonic waves by the volume (L) of a cleaning fluid. The discharge condition of the cleaning fluid by a pump is adjusted such that the proportion (C5) of the brightness of the fluid when 5 seconds has passed since the state wherein both an ultrasonic wave irradiation means and a bubble supply means are concurrently operating to the brightness of the fluid when no bubbles exist in the fluid is 0.75 or less. The coalition and crush of bubbles due to the irradiation of ultrasonic waves are suppressed, and the both actions can be utilized for a long period.

9 Claims, 12 Drawing Sheets

ULTRASONIC CLEANING METHOD, AND ULTRASONIC CLEANING APPARATUS

BACKGROUND OF THE INVENTION

1. Field of the Invention

The present invention relates to an ultrasonic cleaning method and an ultrasonic cleaning apparatus for cleaning an article-to-be-cleaned immersed in a cleaning fluid. The "cleaning an article-to-be-cleaned" means the removal of an object-to-be-removed (contaminant) adhering to the surface of the article-to-be-cleaned.

2. Description of Related Art

Conventionally, a technology for cleaning an article-to-be-cleaned by irradiating ultrasonic waves to a cleaning fluid in which the article-to-be-cleaned is immersed (hereinafter, referred to as an "ultrasonic cleaning") is widely known. In accordance with an ultrasonic cleaning, by imparting vibration energy of ultrasonic waves to a cleaning fluid, actions such as the generation of an impact wave by generating and breaking of bubbles due to cavitation in the cleaning fluid, an acceleration of the molecule of the cleaning fluid, and an acceleration of a physicochemical reaction are exerted. As a result, an object-to-be-removed (contaminant) adhering to the surface of the article-to-be-cleaned is removed from the article-to-be-cleaned. Hereinafter, cleaning actions obtained by using the ultrasonic cleaning may be referred to as "ultrasonic cleaning actions", and the above-described actions may be referred to as "conventional ultrasonic cleaning actions".

Meanwhile, a technology for cleaning an article-to-be-cleaned by supplying bubbles (particularly, bubbles with a diameter of 100 μm or less, may be referred to as microbubbles) into a cleaning fluid in which the article-to-be-cleaned is immersed (hereinafter, referred to as a "bubble cleaning") is also known. In accordance with a bubble cleaning, effects such as an adhesion of oily content to the surface of bubbles, detachment of an object-to-be-removed by impact power upon the crush of bubbles by a physical force are exerted. As a result, the object-to-be-removed is removed from the article-to-be-cleaned. Hereinafter, cleaning actions obtained by using the bubble cleaning may be referred to as a "bubble cleaning action", and the above-described actions may be referred to as a "conventional bubble cleaning action".

In order to concurrently utilize such an ultrasonic cleaning action and a bubble cleaning action to effectively clean an article-to-be-cleaned, it can be supposed to irradiate ultrasonic waves to a cleaning fluid in a state wherein bubbles exist in the cleaning fluid in which the article-to-be-cleaned is immersed. However, as shown in FIG. 13(*a*), for example, when normal ultrasonic waves with a frequency of about 20 kHz and a power of about 25 W/L (watt/liter) is irradiated, a phenomenon where bubbles aggregate at places corresponding to the node(s) or anti-node(s) in the oscillation (waveform) of the ultrasonic waves, and the aggregated bubbles coalesce and rise toward the surface to instantly disappear from the cleaning fluid occurs. In other words, the decreasing rate of the bubbles (bubble density) in the cleaning fluid is extremely high. As a result, it is impossible to concurrently utilize an ultrasonic cleaning action and a bubble cleaning action. Herein, bubbles tend to aggregate at the anti-node(s) when the bubble diameter is smaller than the co-called "resonant bubble diameter" of the irradiated ultrasonic waves, while bubbles tend to aggregate at the node(s) when the bubble diameter is larger than the "resonant bubble diameter".

Therefore, Patent Document 1 (will be mentioned later) describes a technology where ultrasonic waves stronger (specifically, with a larger amplitude) than normal ultrasonic waves as described above are irradiated when ultrasonic waves are irradiated to a cleaning fluid in a state wherein bubbles exist in the cleaning fluid in which an article-to-be-cleaned is immersed. It describes that, thereby, as shown in FIG. 13(*b*), the bubble is crushed positively by vibration energy of the strong ultrasonic waves to generate a radical, and, by the action of this radical, an object-to-be-removed (particularly, organic contaminant) is instantly decomposed and removed.

Patent Document 2 (will be mentioned later) also describes that, similarly to Patent Document 1, an object-to-be-removed is removed from an article-to-be-cleaned by positively crushing bubbles. As described above, in accordance with Patent Documents 1 and 2, an article-to-be-cleaned is cleaned by using a new action derived from the positive crushing of bubbles, instead of concurrently utilizing an ultrasonic cleaning action and a bubble cleaning action.

However, when an action based on the positive crushing of bubbles is utilized to clean an article-to-be-cleaned, there were some problems such as the necessity of accurate control of the position at which bubbles are crushed (i.e. the position to which ultrasonic waves are irradiated), the difficulty in cleaning a large article-to-be-cleaned due to a narrow area in which cleaning can be effectively performed, the likelihood of the damage of the surface of an article-to-be-cleaned due to the irradiation of strong ultrasonic waves.

[Patent Document 1] Japanese Patent Application Laid-Open (kokai) No. 2007-253120

[Patent Document 2] Japanese Patent Application Laid-Open (kokai) No. 2008-119642

SUMMARY OF THE INVENTION

An object of the present invention is to provide an ultrasonic cleaning method capable of effectively cleaning an article-to-be-cleaned by concurrently utilizing an ultrasonic cleaning action and a bubble cleaning action.

According to a first aspect of the present invention there is provided an ultrasonic cleaning method, using: an ultrasonic wave irradiation means for irradiating ultrasonic waves to a cleaning fluid retained in a cleaning bath, and a bubble supply means for supplying bubbles to the retained cleaning fluid (by circulating the retained cleaning fluid through a pump and mixing gas in to the cleaning fluid discharged from the pump), and cleaning an article-to-be-cleaned immersed in the retained cleaning fluid by irradiating ultrasonic waves to the retained cleaning fluid by means of the ultrasonic wave irradiation means in a state wherein bubbles exist in the retained cleaning fluid by virtue of the operation of the bubble supply means. Herein, it is supposed that the "bubbles" have an average diameter of 100 μm or less (so-called microbubbles). In addition, it is supposed that the object-to-be-removed adhering to the surface of an article-to-be-cleaned, which is a target to be removed by cleaning, has a thickness of (0.05 μm or more and) 5.00 μm or less.

In an aspect of the above-described present invention, the operation of the ultrasonic wave irradiation means is controlled to materialize the relation represented by the following equation:

$$0.04f-20.0 \leqq P \leqq 0.09f-7.5$$

where f (unit: kHz) is the frequency of the ultrasonic waves irradiated by the ultrasonic wave irradiation means and P (unit: W/L) is the power per unit fluid volume obtained by dividing the power (unit: W) of the ultrasonic waves irradiated by the ultrasonic wave irradiation means by the volume (unit: L) of the retained cleaning fluid, and the operation of the bubble supply means is controlled to adjust the proportion (hereinafter, may be referred to as "C5") of the brightness of cleaning fluid when 5 seconds has passed since the state where both the ultrasonic wave irradiation means and the bubble supply means are concurrently operating to the brightness of cleaning fluid when no bubbles exist in the retained cleaning fluid to 0.75 or less, wherein the brightness of cleaning fluid is calculated through a certain processing on the image obtained by photographing the retained cleaning fluid under a certain condition. The ultrasonic wave irradiation means and the bubble supply means may start their operation at the same time, while one of the ultrasonic wave irradiation means and the bubble supply means may start its operation first and the other may start its operation afterwards.

It was revealed that the occurrence of the above-described coalition and crush of bubbles due to the irradiation of ultrasonic waves are suppressed by adjusting the frequency and power of ultrasonic waves and the discharge condition of a cleaning fluid through a pump as in the above configuration. Thereby, it is possible to have bubbles remain for a long period in a cleaning fluid during the irradiation of ultrasonic waves. Accordingly, it is possible to concurrently utilize an ultrasonic cleaning action and a bubble cleaning action and to effectively clean an article-to-be-cleaned.

In addition, in the combination of the frequency and power of ultrasonic waves in the above configuration, the frequency of ultrasonic waves is adjusted to a large value to secure sufficient vibration energy of ultrasonic waves, while the power of ultrasonic waves is adjusted to a small value to make the amplitude of ultrasonic waves small. Herein, when an extremely thin object-to-be-removed with a thickness of 5.00 μm or less adheres on the surface of a highly rigid article-to-be-cleaned (substrate), it is possible to generate a crack in the object-to-be-removed by only imparting a slight displacement to the object-to-be-removed. Therefore, even though the amplitude of ultrasonic waves is small as described above, it is possible to generate a crack in an object-to-be-removed and to start removing the object-to-be-removed from an article-to-be-cleaned at the crack. In other words, by utilizing a new ultrasonic cleaning action derived from the generation of crack, it is possible to effectively clean an article-to-be-cleaned without any large power as required by the apparatus described in the above documents.

In the ultrasonic cleaning method according to the above-described present invention, it is suitable to intermittently irradiate ultrasonic waves by means of the ultrasonic wave irradiation means. Thereby, the disappearance of bubbles through the above-described coalescence or crush of bubbles due to the irradiation of ultrasonic waves occurs intermittently. Therefore, as compared with the case where ultrasonic waves are continuously irradiated, bubbles in a cleaning fluid (bubble density) becomes more unlikely to decrease, and a bubble cleaning action functions more effectively.

In addition, in the above-described ultrasonic cleaning method according to the present invention, as the cleaning fluid, a liquid, to which a surfactant is added, may be used. In a cleaning fluid with a surfactant added thereto, the coalescence of bubbles is suppressed, and a diameters of bubbles are reduced (will be described later in detail). As a result, the initial number of bubbles in the cleaning fluid can be increased, and a bubble cleaning action functions more effectively in some cases.

Further, in the above-described ultrasonic cleaning method according to the present invention, as the cleaning fluid, a liquid with a surface tension of 30 mN/m or more is suitably used. Furthermore, the contact angle between the object-to-be-removed and the cleaning fluid is suitably 90 degrees or more. In this case, for example, a combination of a fluorocarbon as the object-to-be-removed and water as the cleaning fluid may be adopted.

Thus, the fact that the wettability of a cleaning fluid to an object-to-be-removed is sufficiently low means that a force is generated in a direction to narrow the contact area between an object-to-be-removed and an article-to-be-cleaned (i.e., the interfacial tension on the interface between an object-to-be-removed and an article-to-be-cleaned) is large. In other words, bubbles and an object-to-be-removed tend to positively contact with each other. Therefore, when bubbles are about to move under the influence of buoyancy or the like, a force is generated on the interface between an object-to-be-removed and an article-to-be-cleaned in a direction to maintain the contact area. By virtue of this force, a force to move the object-to-be-removed to follow the movement of the bubbles acts on the article-to-be-cleaned. Thus, by utilizing the new bubble cleaning action by virtue of the interfacial tension of a cleaning fluid (different from a conventional bubble cleaning action), it becomes easier to detach and remove an object-to-be-removed from an article-to-be-cleaned, and the article-to-be-cleaned can be effectively cleaned.

According to a second aspect of the present invention, an ultrasonic cleaning apparatus is provided, comprising a cleaning bath for retaining a cleaning fluid, an ultrasonic wave irradiation means for irradiating ultrasonic waves to the retained cleaning fluid, and a bubble supply means for supplying bubbles to the retained cleaning fluid, and cleaning an article-to-be-cleaned immersed in the retained cleaning fluid by irradiating ultrasonic waves to the retained cleaning fluid by means of the ultrasonic wave irradiation means in a state where bubbles exist in the retained cleaning fluid by virtue of the operation of the bubble supply means. The ultrasonic wave irradiation means operates such that the relation represented by the following equation is materialized:

$$0.04f-20.0 \leqq P \leqq 0.09f-7.5$$

where f (unit: kHz) is the frequency of the ultrasonic waves irradiated by said the ultrasonic wave irradiation means and P (unit: W/L) is the power per unit fluid volume obtained by dividing the power (unit: W) of the ultrasonic waves irradiated by the ultrasonic wave irradiation means by the volume (unit: L) of the retained cleaning fluid, and the bubble supply means operates such that the proportion of the brightness of the cleaning fluid when 5 seconds has passed since the state where both the ultrasonic wave irradiation means and the bubble supply means are concurrently operating to the brightness of the cleaning fluid when no bubbles exist in the retained cleaning fluid is 0.75 or less.

DETAILED DESCRIPTION OF THE INVENTION

An ultrasonic cleaning method (ultrasonic cleaning apparatus) according to an embodiment of the present invention will next be described with reference to the drawings.

(Configuration)

Figure 1:
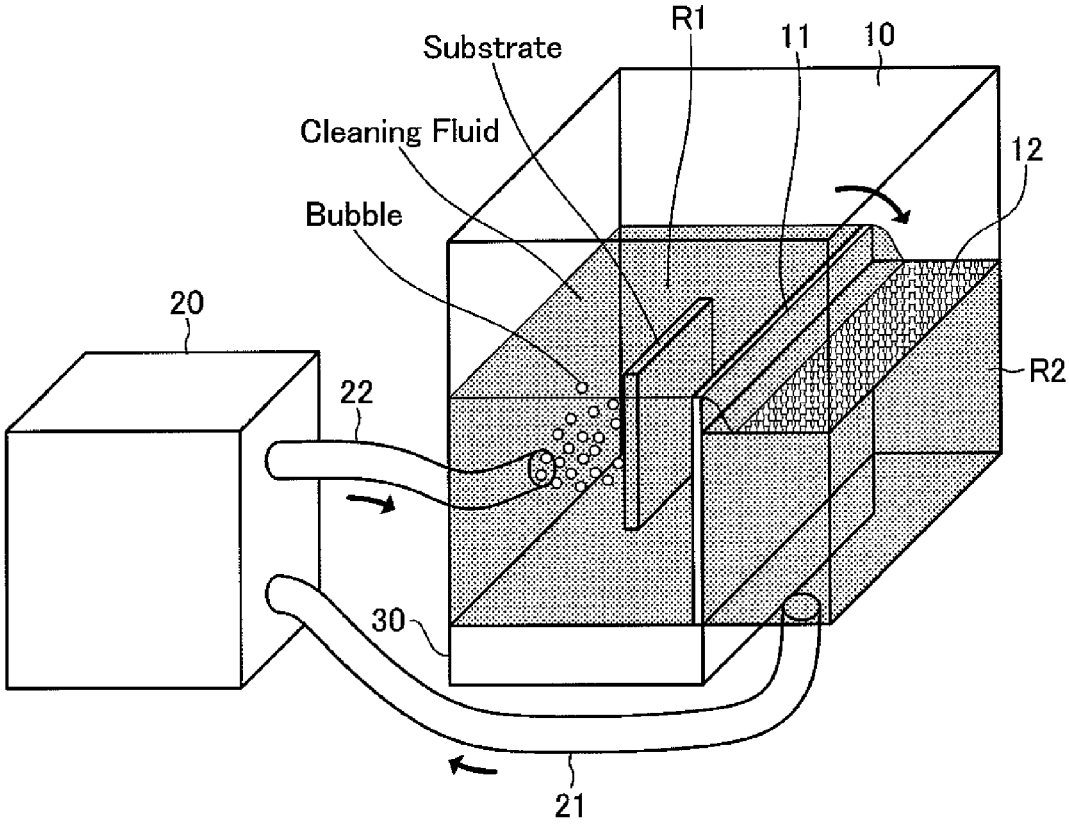
FIG. 1 is a view, showing the schematic configuration of an ultrasonic cleaning apparatus used in an ultrasonic cleaning method according to an embodiment according to the present invention.

FIG. 1 shows the schematic configuration of an ultrasonic cleaning apparatus used in an ultrasonic cleaning method according to an embodiment according to the present invention. In a Cleaning Bath 10, a cleaning fluid is retained. As a cleaning fluid, for example, water, solvents, alternatives for chlorofluorocarbon can be used. In the present embodiment, as a cleaning fluid, particularly "water", which has a large surface tension of 70 mN/m or more, is supposed.

In the Cleaning Bath 10, a Partition Plate 11 is placed. The Partition Plate 11 partitions the inside of the Cleaning Bath 10 into a First Compartment R1 and a Second Compartment R2. The First Compartment R1 is a space for retaining and fixing a dirty substrate, which is an article-to-be-cleaned, to immerse the substrate in a cleaning fluid (substantial cleaning bath).

On the Second compartment R2 side of the Partition Plate 11, a Filter 12 is placed. The cleaning fluid that overflows beyond the upper surface of the Partition Plate 11 is retained in the Second Compartment R2 after being filtered through the Filter 12. Namely, the Second Compartment R2 is a space for retaining a clean cleaning fluid after being filtered off an object-to-be-removed or the like, which has been removed from the dirty substrate in the First Compartment R1.

The Bubble Supply Apparatus 20 is configured in accordance with one of well-known configuration (specifically, a swirling flow type), sucks a cleaning fluid from the Second Compartment R2 by means of a pump through a Suction Pipe 21 connected with the Second Compartment R2, and mixes gas (e.g., oxygen, nitrogen, ozone) into the sucked cleaning fluid within the pump. Hereinafter, the cleaning fluid with gas mixed therein may be referred to as a "gas-mixed cleaning fluid". Then, within the pump, the flow of the gas-mixed cleaning fluid is converted from a linear flow to a swirling flow by pressure. The collision and dispersion of the gas-mixed cleaning fluid occur due to the centrifugal force, pressure fluctuation, or the like generated through the conversion, and the collision and dispersion generate bubbles. The gas-mixed cleaning fluid containing the bubbles is discharged into the First Compartment R1 by means of a pump through a Supply Pipe 22 connected with the First Compartment R1. Thereby, while the cleaning fluid is circulated, the bubbles are supplied to the cleaning fluid within the First Compartment R1. Thus, as the Bubble Supply Apparatus 20, a swirling flow type is adopted, since this type can easily supply bubbles in a continuous manner. Other examples of the Bubble Supply Apparatus 20 include a static mixer type, a pressurizing dissolution type, a Venturi type, a method using fine pores, and the like.

The average diameter of the bubbles generated by the Bubble Supply Apparatus 20 (average bubble diameter) is less than 100 μm, and such bubbles may be referred to as "microbubbles". The Bubble Supply Apparatus 20 is configured such that the discharge rate per unit time of a cleaning fluid by means of a pump (circulation flow rate of a cleaning fluid) and the amount per unit time of gas mixed therein (mixing flow rate of gas) can be adjusted.

Now, the measurement of the diameter of bubbles is additionally explained. In the present example, in a state wherein the Bubble Supply Apparatus 20 is in operation, bubbles were introduced into a slit portion manufactured inside the Cleaning Bath 10. The cleaning fluid thus introduced into the slit portion was photographed by means of a microscope, and fifty images were obtained. The diameters of bubbles were measured by using these images. The number of the measured bubbles was about 400. The measurable minimum bubble diameter is 10 μm, and 97% of the measured bubbles has a diameter of 100 μm or less. A histogram was made from the measured diameters of bubbles, and the bubble diameter at an accumulated frequency of 50% was adopted as an average bubble diameter. Also, the bubble diameter at an accumulated frequency of 95% was adopted as a maximum bubble diameter. In the present example, the average bubble diameter was 38 μm, and the maximum bubble diameter was 89 μm.

The Ultrasonic Wave Irradiation Apparatus 30 is an ultrasonic transducer configured in accordance with one of well-known configurations, and is placed at the bottom of the First Compartment R1. The Ultrasonic Wave Irradiation Apparatus 30 is so configured as to impart ultrasonic waves to the bottom of the First Compartment R1. Thereby, ultrasonic waves are irradiated to a cleaning fluid within the First Compartment R1. The Ultrasonic Wave Irradiation Apparatus 30 is configured such that the frequency and power of the ultrasonic waves irradiated to a cleaning fluid within the First Compartment R1 can be adjusted, as well as ultrasonic waves can be irradiated either continuously or intermittently.

Figure 2:
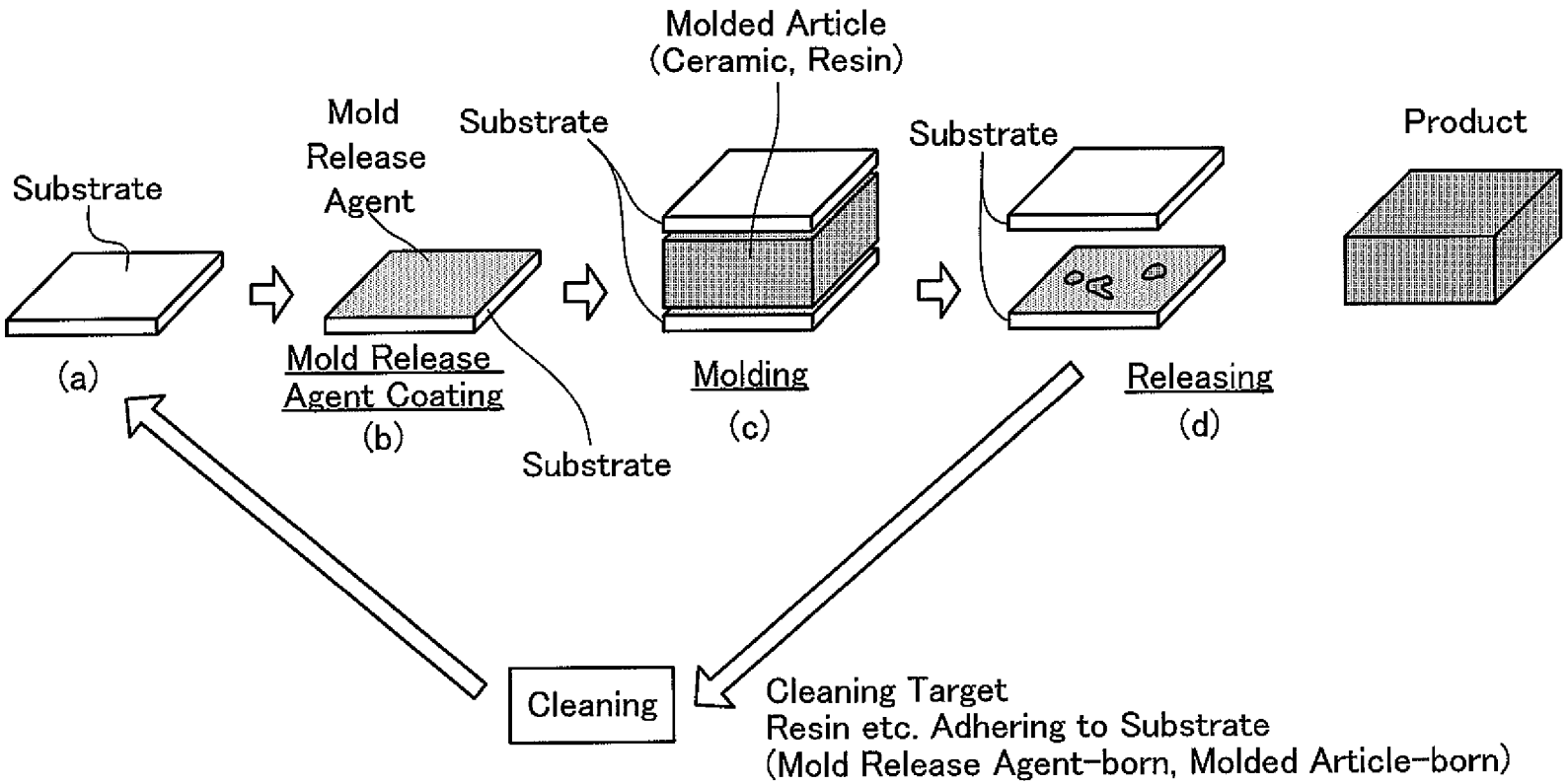
FIG. 2 is a view, explaining an example of a dirty article-to-be-cleaned (substrate) cleaned in the ultrasonic cleaning apparatus shown in FIG. 1.

In this embodiment, as a dirty substrate, which is an article-to-be-cleaned, as shown in FIG. 2, a plate-like mold after being used for forming (molding) a molded article made of ceramic or resin is used. More specifically, as shown in FIG. 2 (*b*), a mold release agent is coated on the surface (molding surface) of the plate-like substrate shown in FIG. 2 (*a*). As a mold release agent, a fluorocarbon can be used.

As shown in FIG. 2 (*c*), two substrates with a mold release agent coated on the molding surfaces are fixedly placed such that the molding surfaces face each other at a predetermined distance, and thereby a molding space is formed. Slurry, which is a precursor of the molded article (made of ceramic or resin), is injected in to the molding space, and the slurry is solidified and dried. Thereby, the molded article is formed in the molding space. As shown in FIG. 2 (*d*), the two substrates are released from the molded article thus formed, and the molded article (product) is obtained.

At this time, the molding surface of the substrate is soiled with the mold release agent, or a part of the molded article, adhering thereon. The mold release agent-born or molded article-born solid body adhering to the molding surface of the substrate is cleaned and removed from the substrate as an object-to-be-removed. The clean substrate after the removal of the object-to-be-removed is reused as the mold for forming the above-described molded article.

In this embodiment, as an object-to-be-removed, particularly, an extremely thin, mold release agent-born fluorocarbon with a thickness of 5.00 μm or less, adhering to the molding surface of the substrate is supposed. When the object-to-be-removed is made of a fluorocarbon and water is used as a cleaning fluid, the contact angle between the object-to-be-removed and the cleaning fluid becomes 110 degree or more, and the wettability of the cleaning fluid to the object-to-be-removed becomes sufficiently low. Thereby, the above-described new bubble cleaning action becomes easier to be brought out. This point will be described later in detail.

In addition to fluorocarbons, as the object-to-be-removed, silicon series compounds, acrylic compounds, urethane series compounds, ceramic powders and the like can be exemplified. When the object-to-be-removed is a molded article-born solid body (compact residue), the object-to-be-removed is sometimes in a shape of fine grain. In this case, an ultrasonic cleaning does not generate any crack in the object-to-be-removed (i.e., the above-described new ultrasonic cleaning action is not brought out). On the other hand, since the contact area between an object-to-be-removed and a substrate (article-to-be-cleaned) is small, it becomes possible to detach and remove the object-to-be-removed from the subject mainly by the above-described new bubble cleaning action. In this case, the diameter of the grain corresponds to the thickness of the object-to-be-removed. The new ultrasonic cleaning action and the new bubble cleaning action will be described later in detail.

(Control of Frequency and Power of Ultrasonic Wave, and Control of Discharge of Gas-mixed Cleaning Fluid, According to Present Invention)

Figure 3:
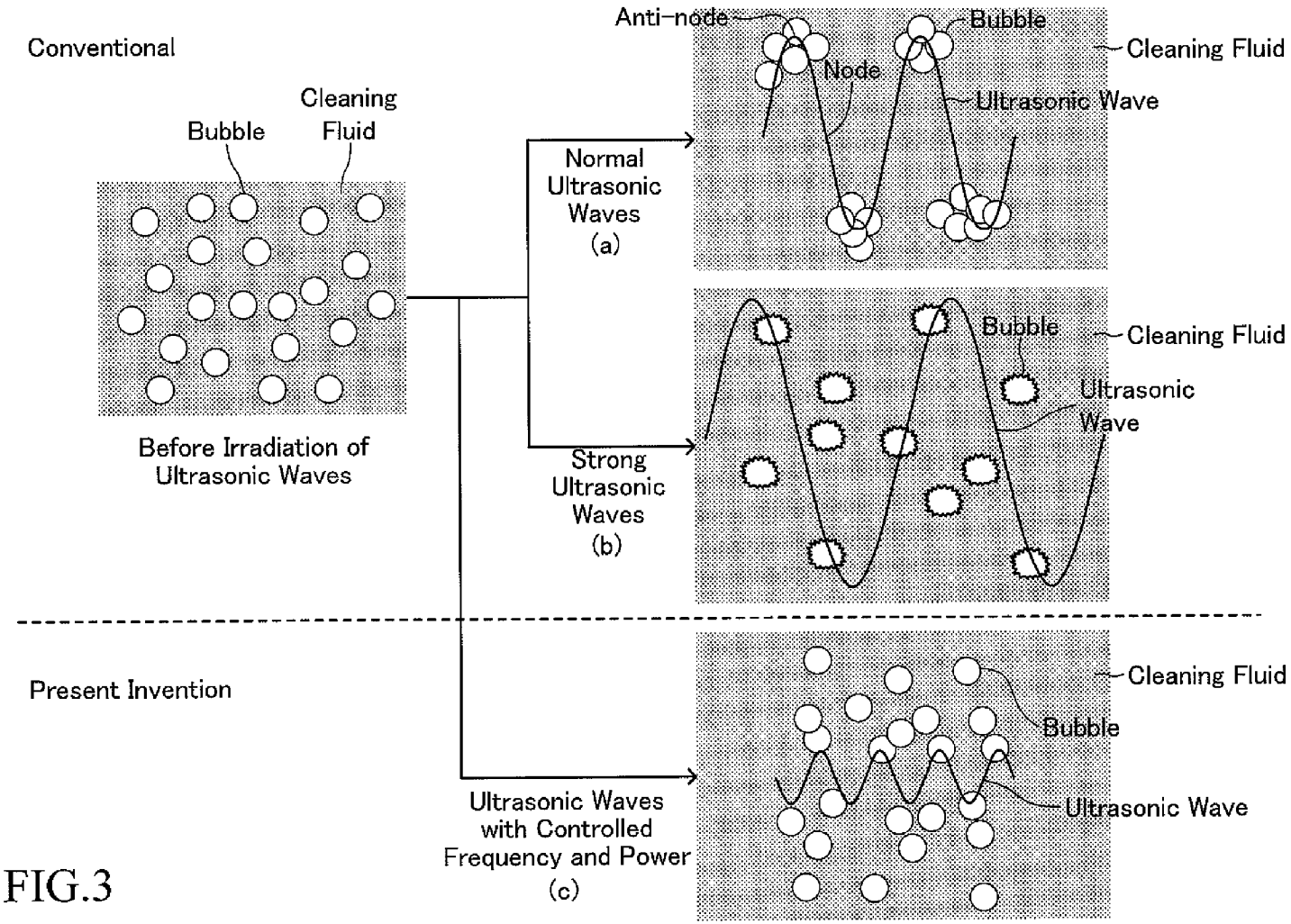
FIG. 3 is a view, comparing conventional patterns of the irradiation of ultrasonic waves with a pattern of the irradiation of ultrasonic waves according to the present invention.

As described above, when normal ultrasonic waves with a frequency of about 20 kHz and a power of about 25 W/L (watt/liter) is irradiated, a phenomenon where bubbles aggregate, and the aggregated bubbles coalesce and rise toward the surface to instantly disappear from a cleaning fluid occurs (refer to FIG. 3 (*a*)). In addition, as described above, when ultrasonic waves stronger (specifically, its amplitude is larger) than the above normal ultrasonic waves are irradiated, a phenomenon where bubbles are positively crushed, and the bubbles instantly disappear from a cleaning fluid occurs (refer to FIG. 3 (*b*)).

Thus, when ultrasonic waves are irradiated in accordance with a conventional pattern, the decreasing rate of bubbles (bubble density) in a cleaning fluid is extremely high. As a result, it is impossible to concurrently utilize an ultrasonic cleaning action and a bubble cleaning action. In this embodiment, the bubble density means the proportion of the "sum total of volumes of bubbles existing in a cleaning fluid (within the First Compartment R1)" to the "volume of a whole cleaning fluid (within the First Compartment R1)".

To the contrary, in this embodiment, the combination of the frequency and power of the ultrasonic waves irradiated by the Ultrasonic Wave Irradiation Apparatus 30 is adjusted to materialize the relation represented by the following equation (1), where f (kHz) is the frequency of the ultrasonic waves and P (W/L) is the power per unit fluid volume obtained by dividing the power (W) of the ultrasonic waves by the volume (L) of the cleaning fluid retained in the First Compartment R1 of the Cleaning Bath 10. Thereby, as shown in FIG. 3 (*c*), the frequency of the ultrasonic waves is adjusted to be sufficiently higher than the frequency of the above normal ultrasonic waves. In addition, the power of the ultrasonic waves is reduced, and thereby the amplitude in the oscillation (waveform) of the ultrasonic waves is made sufficiently smaller than the amplitude of the above normal ultrasonic waves.

$$0.04f-20.0 \leqq P \leqq 0.09f-7.5 \quad (1)$$

In addition, in this embodiment, the discharge condition of the gas-mixed cleaning fluid discharged by the Bubble Supply Apparatus 20 is adjusted such that a value "C5" (will be described later in detail) of a "brightness ratio C", which is a measure representing the bubble density of a cleaning fluid, is 0.75 or less.

Thus, it was revealed that the occurrence of the above-described coalition and crush of bubbles due to the irradiation of ultrasonic waves are suppressed by adjusting the frequency and power of ultrasonic waves and the discharge condition of a cleaning fluid through a pump. Thereby, it is possible to concurrently utilize an ultrasonic cleaning action and a bubble cleaning action and to effectively clean an article-to-be-cleaned. The experiments performed in order to verify this, and the results thereof, will be described below.

EXPERIMENT 1

In Experiment 1, only a bubble cleaning was performed, and a bubble cleaning action was evaluated.

<Molding>

In Experiment 1, on each of the surfaces (molding surfaces, flat surface) of two plate-like substrates made of glass, a mold release agent (fluorocarbons) was coated at a thickness of 0.50 μm. Between the two substrates placed such that each molding surfaces face each other, spacers were intermediately fixed, and a molding space confined by each molding surfaces and the spacers was formed. Into the molding space, slurry was injected, and, by solidifying and drying the slurry, a compact was formed in the molding space. This compact was released from the two substrates. The mold release agent-born fluorocarbon remained adhered to each of the substrates after releasing, and the thickness thereof was 0.50 μm (the same as the coating thickness). The thickness was measured by using a laser microscope. The same molding was also performed on a combination of substrates made of duralumin and a mold release agent which is a fluorocarbon. Also in this case, the mold release agent-born fluorocarbon with a thickness of 0.50 μm remained adhered to each of the substrates after releasing. The dirty substrates in a state where the mold release agent thus adhered thereto (objects-to-be-removed) were used as the articles-to-be-cleaned. <Cleaning>

The Cleaning Bath 10 was filled with 20 L of a cleaning fluid (ion-exchanged water). The temperature of the cleaning fluid was adjusted constant at 27° C. The capacity of the First Compartment R1 was 10 L. The filled cleaning fluid was circulated by a pump. The circulation flow rate of the cleaning fluid was 10 L/min, and the mixing flow rate of gas (oxygen) was 0.5 L/min. Under this condition, bubbles were supplied into the First Compartment R1 of the Cleaning Bath 10. As the method for generating bubbles, the swirling flow type well-known as described above was adopted. The average diameter of the bubbles was 38 μm. In a state where bubbles were being supplied under this condition, an article-to-be-cleaned was immersed and cleaned in the First Compartment R1 for 30 seconds. After cleaning, the article-to-be-cleaned was observed by using a laser microscope. The results are shown in Table 1.

TABLE 1

| Cleaning | Substrate Material | Object-to-be-removed Material | Thickness of Object-to-be-removed [μm] | Contact Angle [degree] | Cleaning Grade* |
|---|---|---|---|---|---|
| Bubble | Glass | Fluorocarbon | 0.50 | 115 | M |
| " | Duralumin | Fluorocarbon | " | 110 | P |

*G: Good (90% or more of substrate surface was cleaned),
M: Moderate (30% to 90% of substrate surface was cleaned), and
P: Poor (less than 30% of substrate surface was cleaned).

As shown in Table 1, in the case of the combination of the glass substrate and the mold release agent which is a fluorocarbon, the objects-to-be-removed were removed from about 60% of the surface area of molding surface. On the other hand, in the case of the combination of the duralumin substrate and the mold release agent which is a fluorocarbon, the objects-to-be-removed could not be removed at all. As the above, only with the bubble cleaning, a sufficient cleaning action was not obtained.

EXPERIMENT 2

In Experiment 2, only an ultrasonic cleaning was performed, and an ultrasonic cleaning action was evaluated.

<Molding>

In Experiment 2, the same molding as in Experiment 1 was performed only on a combination of substrates made of duralumin and a mold release agent which is a fluorocarbon. Also in this case, the thickness of an object-to-be-removed (fluorocarbon) remained on the molding surface of an article-to-be-cleaned (substrate) was 0.50 μm (the same as the coating thickness).

<Cleaning>

Also in Experiment 2, the Cleaning Bath 10 was filled with the same cleaning fluid as that in Experiment 1. In a state wherein gas was not mixed into the cleaning fluid circulated by a pump (i.e., bubbles were not supplied), the article-to-be-cleaned was immersed within the First Compartment R1. Then, ultrasonic waves were irradiated to the First Compartment R1 for 30 seconds, and thereby the article-to-be-cleaned was cleaned. The combinations of the frequencies and the powers of the ultrasonic waves were as shown in Table 2. The results of Experiment 2 are shown in Table 2.

TABLE 2

| Cleaning Condition: | | | | |
|---|---|---|---|---|
| Cleaning | Substrate Material | Object-to-be-removed Material | Thickness of Object-to-be-removed [μm] | Contact Angle [degree] |
| Ultrasonic | Duralumin | Fluorocarbon | 0.50 | 110 |

| Cleaning Grade*: | | | | | | | | |
|---|---|---|---|---|---|---|---|---|
| Only Ultrasonic Waves | | Frequency [kHz] | | | | | | |
| | | 28 | 45 | 100 | 200 | 750 | 1000 | 2000 |
| Power [W] | 100 | P | P | P | P | P | P | P |
| | 200 | P | P | P | P | P | P | P |
| | 600 | M | M | P | P | P | P | P |
| | 1200 | M | M | P | P | P | P | P |

*G: Good (90% or more of substrate surface was cleaned),
M: Moderate (30% to 90% of substrate surface was cleaned), and
P: Poor (less than 30% of substrate surface was cleaned).

As shown in Table 2, in the cases of the combinations of the powers of 600 and 1200 W and the frequencies of 28 and 45 kHz, the objects-to-be-removed were removed from about 40% of the surface area of molding surface. On the other hand, in the case of other combinations, the objects-to-be-removed could be hardly removed. As the above, only with the ultrasonic cleaning, a sufficient cleaning action was not obtained.

EXPERIMENT 3

In Experiment 3, a bubble cleaning and an ultrasonic cleaning were concurrently performed, and the combination of a bubble cleaning action and an ultrasonic cleaning action was evaluated.

<Molding>

In Experiment 3, the same molding as in Experiment 1 was performed only on a combination of substrates made of duralumin and a mold release agent which is a fluorocarbon. Also in this case, the thickness of an object-to-be-removed (fluorocarbon) remained on the molding surface of an article-to-be-cleaned (substrate) was 0.50 μm (the same as the coating thickness).

<Cleaning>

In Experiment 3, in a state where the article-to-be-cleaned was immersed within the First Compartment R1 and bubbles were being supplied under the same condition as that in Experiment 1 (Circulation Flow Rate of Cleaning Fluid: 10 L/min, Mixing Flow Rate of Gas: 0.5 L/min), ultrasonic waves were irradiated to the First Compartment R1 for 30 seconds, and thereby the article-to-be-cleaned was cleaned. The combinations of the frequencies and the powers of the ultrasonic waves were the same as those in Experiment 2. The results of Experiment 3 are shown in Table 3 and FIG. 4.

TABLE 3

| Cleaning Condition: | | | | |
|---|---|---|---|---|
| Cleaning | Substrate Material | Object-to-be-removed Material | Thickness of Object-to-be-removed [μm] | Contact Angle [degree] |
| Ultrasonic and Bubble | Duralumin | Fluorocarbon | 0.50 | 110 |

| Cleaning Evaluation: | | | | | | | | |
|---|---|---|---|---|---|---|---|---|
| Ultrasonic and Bubble | | Results | Frequency [kHz] | | | | | | |
| | | | 28 | 45 | 100 | 200 | 750 | 1000 | 2000 |
| Power [W] | 100 | C5 Cleaning Grade* | 1.0 P | 1.0 P | 0.95 P | 0.74 G | 0.63 G | 0.59 P | 0.50 P |
| | 200 | C5 Cleaning Grade* | 1.0 P | 1.0 P | 1.0 P | 1.0 P | 0.68 G | 0.62 G | 0.53 P |
| | 600 | C5 Cleaning Grade* | 1.0 M | 1.0 M | 1.0 P | 1.0 P | 0.73 G | 069 G | 0.63 G |
| | 1200 | C5 Cleaning Grade* | 1.0 M | 1.0 M | 1.0 P | 1.0 P | 0.91 P | 0.88 P | 0.69 G |

*G: Good (90% or more of substrate surface was cleaned),
M: Moderate (30% to 90% of substrate surface was cleaned), and
P: Poor (less than 30% of substrate surface was cleaned).

As shown in Table 3, in the cases of the combinations of the power of 100 W and the frequencies of 200 and 750 kHz, the combinations of the power of 200 W and the frequencies of 750 and 1000 kHz, the combinations of the power of 600 W and the frequencies of 750, 1000, and 2000 kHz, and the combination of the power of 1200 W and the frequency of 2000 kHz, the objects-to-be-removed were removed from approximately whole area of molding surface. In the cases of the combinations of the powers of 600 and 1200 W and the frequencies of 28 and 45 kHz, the objects-to-be-removed were removed from about 40% of the surface area of molding surface. In these cases, in light of the fact that the bubbles immediately disappeared after the irradiation of the ultrasonic waves started, these cleaning effect resulted from an ultrasonic cleaning action. On the other hand, in the case of other combinations, the objects-to-be-removed could be hardly removed.

Figure 4:
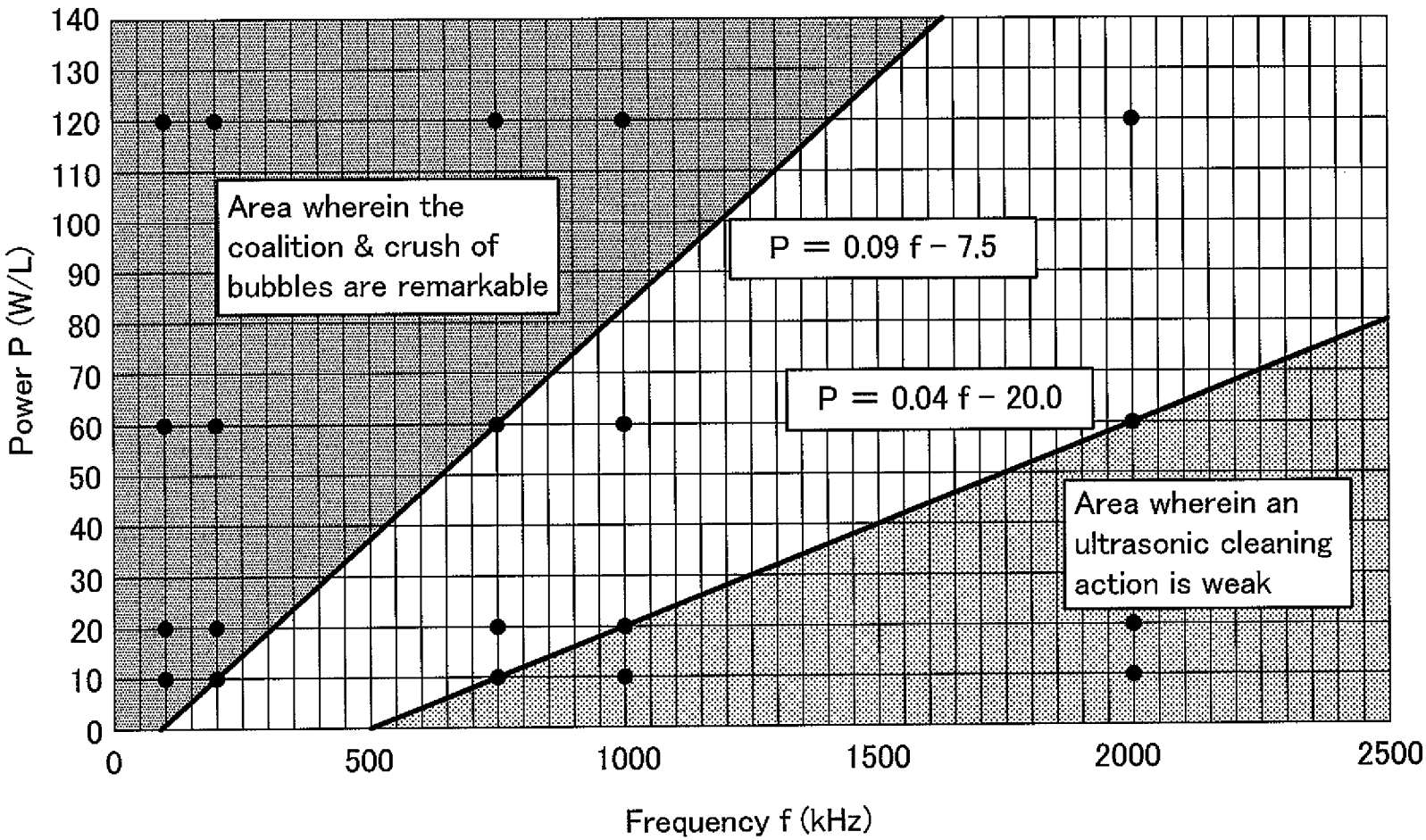
FIG. 4 is a graph, showing the relation between the combinations of the frequencies and powers of ultrasonic waves and the detergency.

As shown in FIG. 4, under the condition where the equation "P>0.09f −7.5" is materialized, the bubbles disappeared immediately. Namely, the coalition and crush of the bubbles remarkably occurred. As a result, the bubble cleaning action was hardly obtained, and a sufficient cleaning action was not obtained. This is believed due to the fact that the power of the ultrasonic waves was too large to its frequency (accordingly, the amplitude of the ultrasonic waves was too large).

On the other hand, under the condition where the equation "P<0.04f−20.0" is materialized, after the irradiation of the ultrasonic started, sufficient bubbles continuously remained. Namely, the coalition and crush of the bubbles hardly occurred. However, the ultrasonic cleaning action was not sufficiently obtained, and a sufficient cleaning action was not obtained. This is believed due to the fact that the power of the ultrasonic waves was too small to its frequency (accordingly, the amplitude of the ultrasonic waves was too small).

To the contrary, under the condition (the combinations of the frequencies and powers of the ultrasonic waves) where the above equation (1) is materialized, after the irradiation of the ultrasonic started, sufficient bubbles continuously remained and, in addition, the ultrasonic cleaning action and the bubble cleaning action could be concurrently utilized, and the articles-to-be-cleaned could be effectively cleaned.

As described above, from the viewpoint of the combinations of frequencies and powers of ultrasonic waves, the conditions wherein an articles-to-be-cleaned can be effectively cleaned were discussed. In addition thereto, in Experiment 3, from the viewpoint of the bubble density in a cleaning fluid, the conditions wherein an articles-to-be-cleaned can be effectively cleaned were discussed.

Taking into account the difficulty in directly measuring the bubble density in a cleaning fluid, as a measure representing the bubble density in a cleaning fluid, the brightness ratio C was introduced. The brightness ratio C at a certain point of time means the proportion (≦1) of the "brightness" of a cleaning fluid retained in the First Compartment R1 at that point of time to the "brightness" of the cleaning fluid when no bubbles exist in the cleaning fluid. The "brightness" is calculated through a certain processing on the image obtained by photographing the cleaning fluid (retained cleaning fluid) in the First Compartment R1 under a certain condition.

Figure 5:
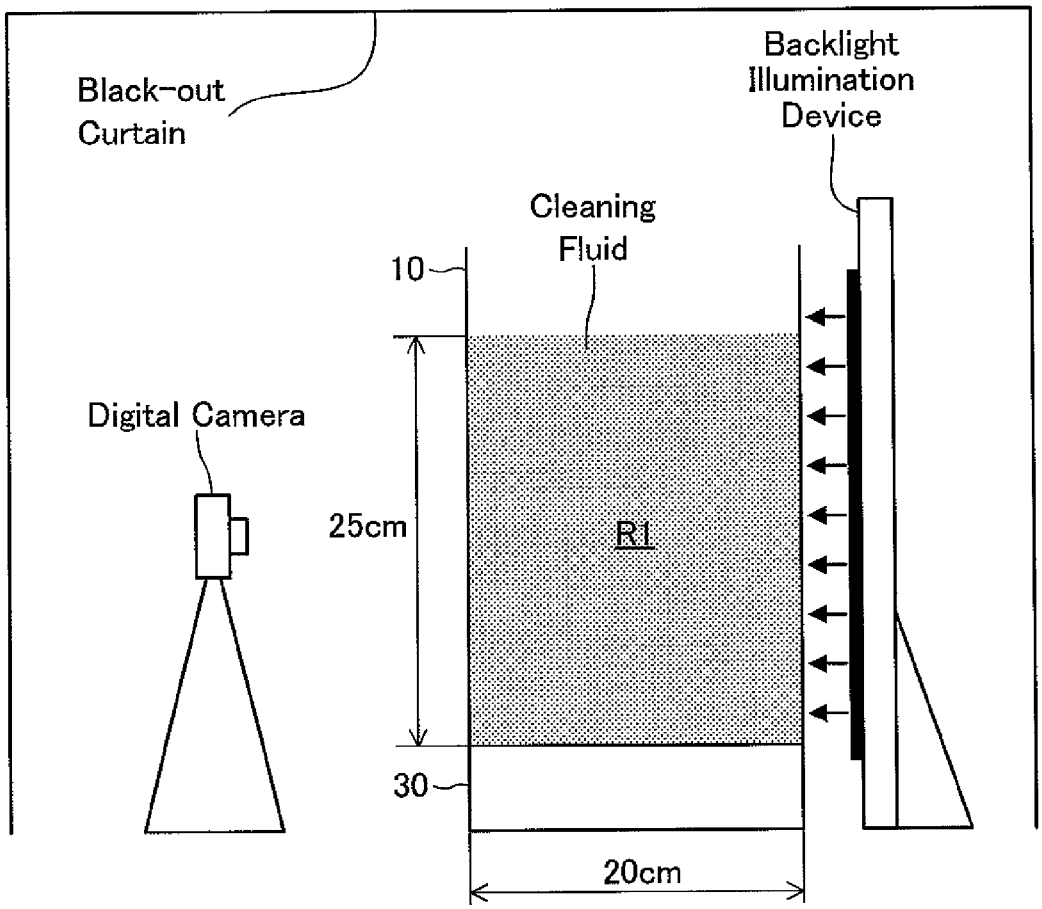
FIG. 5 is a schematic view, showing the method for photographing a cleaning fluid to obtain an image used for the calculation of the brightness of cleaning fluid.
Figure 6:
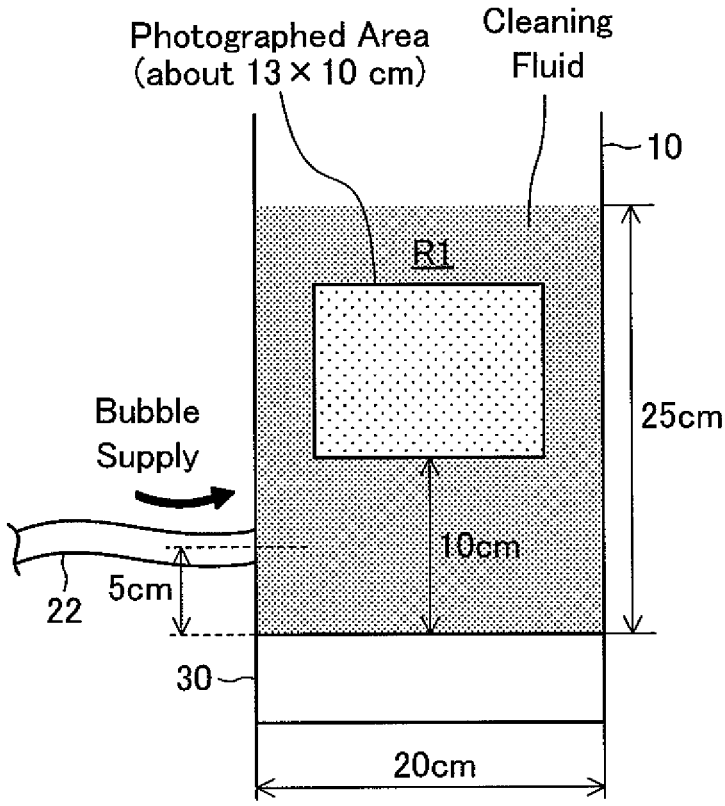
FIG. 6 is a schematic view, showing the image used for the calculation of the brightness of cleaning fluid.

In the present example, as shown in FIG. 5 and FIG. 6, in a dark room covered with a black-out curtain having a light shielding rate of 99%, the Cleaning Bath 10 made of acrylic board with a thickness of 2 cm (Bottom Shape of First Compartment R1: 20×20 cm, Fluid Depth in First Compartment R1: 25 cm) was illuminated by using a well-known backlight illumination device (Illumination Area: 50×38 cm, Luminance: 6000 cd/m$^2$) placed in a predetermined position. In FIG. 5 and FIG. 6, for the sake of convenience in explanation, the Second Compartment R2 was omitted. In this state, a predetermined area (13×10 cm) of the cleaning bath (accordingly, cleaning fluid) was photographed by using a well-known digital camera. The size of the image obtained by the photographing was set to be 2048×1536 pixel. The average value of the brightness values (having gradations of 1 to 255) of the plural picture elements within the image was adopted as the "brightness". The brightness ratio C5 can be used as a measure for the bubble density in a cleaning fluid. The smaller the brightness ratio C means, the larger the bubble density in a cleaning fluid is.

Figure 7:
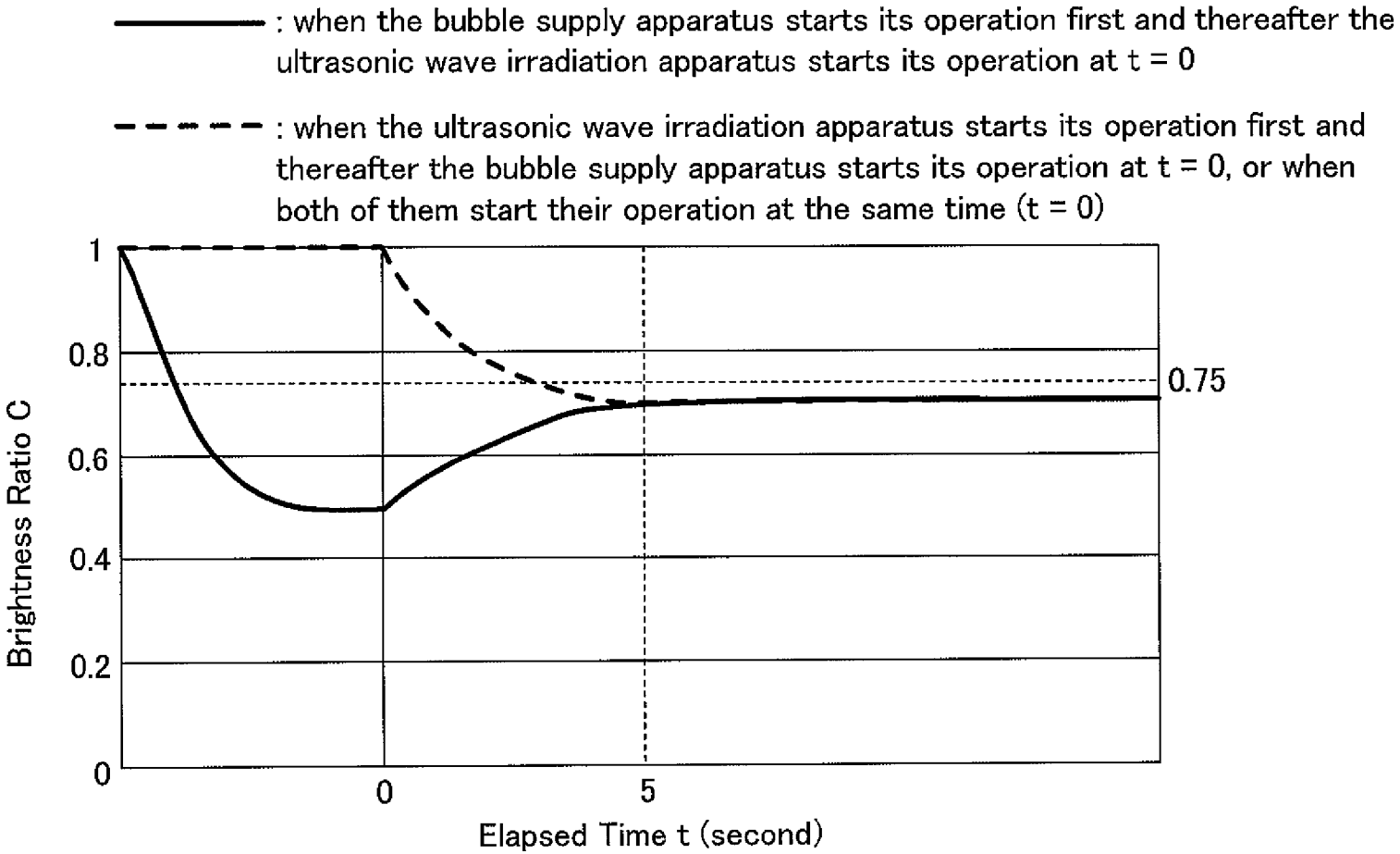
FIG. 7 is a graph, showing an example of the difference in the transition of the proportion of the brightness due to the differences in the operation of a bubble supply apparatus and the operation of an ultrasonic wave irradiation apparatus.

FIG. 7 shows an example of the transition of the brightness ratio C for a certain combination of the frequency and the power of ultrasonic waves corresponding to the area where the above equation (1) is materialized. The t (second) is time has been elapsed since a state, where the Bubble Supply Apparatus 20 and the Ultrasonic Wave Irradiation Apparatus 30 are concurrently operating, starts. As shown in FIG. 7, in the case where the Ultrasonic Wave Irradiation Apparatus 20 and the Bubble Supply Apparatus 30 start their operation at the same time, as well as in the case where one of the Ultrasonic Wave Irradiation Apparatus 20 and the Bubble Supply Apparatus 30 starts its operation first and the other starts its operation afterwards, the brightness ratio C has already been stable at t=5. This is believed due to the fact that the extent of the coalition of bubbles and the like has already been stable at t=5. Therefore, the brightness ratio C at t=5 (hereinafter, referred to as "C5") is adopted as a specific measure representing the bubble density in a cleaning fluid.

The value of C5 was measured for each of the combinations of the frequency and power of ultrasonic waves shown in FIG. 3. The results are shown in FIG. 3. As shown in FIG. 3, within the area where the above equation (1) is materialized (i.e., within the area where the cleaning grade is Good), C5≦0.75 was materialized. From the results, it can be expected that when C5≦0.75 is materialized, bubbles exist sufficiently in a cleaning fluid, and thereby the bubble cleaning action can be sufficiently brought out. In addition, taking into account that the brightness ratio C is stable at t≧5, it can be expected that when the brightness ratio C transits at 0.75 or less during the period when t is from 5 seconds to a predetermined value (e.g., 10 seconds), bubbles exist sufficiently in a cleaning fluid, and thereby the bubble cleaning action can be sufficiently brought out.

EXPERIMENT 4

In Experiment 4, in a state where the above equation (1) is materialized and C5≦0.75 is materialized, the contact angle of a cleaning fluid (ion-exchanged water) to an object-to-be-removed (mold release agent) was evaluated.

<Molding>

In Experiment 4, the same molding as in Experiment 1 was performed on a combination of substrates made of duralumin and a mold release agent which is a fluorocarbon (Contact Angle of Cleaning Fluid: 110° and a combination of substrates made of duralumin and a mold release agent which is a hydrocarbon series compound (Contact Angle of Cleaning Fluid: 60°). Also in these cases, the thickness of an object-to-be-removed (mold release agent) remained on the molding surface of an article-to-be-cleaned (substrate) was 0.50 μm (the same as the coating thickness).

<Cleaning>

In Experiment 4, as a representative condition within the area where the above equation (1) is materialized, a combination of a power of 100 W and a frequency of 750 kHz was chosen. Then, only for the combination, similarly to Experiment 3, in a state where bubbles were being supplied with the circulation flow rate of the cleaning fluid at 10 L/min and the mixing flow rate of gas at 0.5 L/min, ultrasonic waves were irradiated to the First Compartment R1 for 30 seconds, and thereby the article-to-be-cleaned was cleaned. The results of Experiment 4 are shown in Table 4.

TABLE 4

| Cleaning | Substrate Material | Object-to-be-removed Material | Thickness of Object-to-be-removed [μm] | Contact Angle [degree] | C5 | Cleaning Grade* |
|---|---|---|---|---|---|---|
| Bubble and Ultrasonic | Duralumin | Fluorocarbon | 0.50 | 110 | 0.6 | G |
| Bubble and Ultrasonic | " | Hydrocarbon Series Compound | 0.50 | 60 | " | P |

*G: Good (90% or more of substrate surface was cleaned),
M: Moderate (30% to 90% of substrate surface was cleaned), and
P: Poor (less than 30% of substrate surface was cleaned).

As shown in Table 4, in the case where the object-to-be-removed was the fluorocarbon having a contact angle of 110° with the cleaning fluid, the object-to-be-removed was removed from approximately whole area of molding surface. On the other hand, in the case where the object-to-be-removed was the hydrocarbon series compound having a contact angle of 60° with the cleaning fluid, the object-to-be-removed could be hardly removed. From the above, it was revealed that, in a state where the above equation (1) is materialized and C5≦0.75 is materialized, especially when the contact angle of the cleaning fluid to the object-to-be removed is 90° or more (especially, 110° or more), in particular, the article-to-be-cleaned can be effectively cleaned.

EXPERIMENT 5

In Experiment 5, in a state wherein the above equation (1) is materialized and C5≦0.75 is materialized, the thickness of an object-to-be-removed (mold release agent) was evaluated.

<Molding>

In Experiment 5, the same molding as in Experiment 1 was performed only on a combination of substrates made of duralumin and a mold release agent which is a fluorocarbon with the coating thickness of the mold release agent varied. Also in these cases, the thickness of an object-to-be-removed (mold release agent) remained on the molding surface of an article-to-be-cleaned (substrate) was the same as the coating thickness.

<Cleaning>

In Experiment 5, similarly to Experiment 4, a combination of a power of 100 W and a frequency of 750 kHz was chosen. Then, only for the combination, similarly to Experiment 3, in a state where bubbles were being supplied with the circulation flow rate of the cleaning fluid at 10 L/min and the mixing flow rate of gas at 0.5 L/min, ultrasonic waves were irradiated to the First Compartment R1 for 30 seconds, and thereby the article-to-be-cleaned was cleaned. The results of Experiment 5 are shown in Table 5.

TABLE 5

| Cleaning | Substrate Material | Object-to-be-removed Material | Thickness of Object-to-be-removed [μm] | Contact Angle [degree] | C5 | Cleaning Grade* |
|---|---|---|---|---|---|---|
| Bubble and Ultrasonic | Duralumin | Fluorocarbon | 0.50 | 110 | 0.6 | G |
| Bubble and Ultrasonic | " | " | 1.00 | " | " | G |
| Bubble and Ultrasonic | " | " | 3.00 | " | " | G |
| Bubble and Ultrasonic | " | " | 5.00 | " | " | G |
| Bubble and Ultrasonic | " | " | 10.00 | " | " | P |

*G: Good (90% or more of substrate surface was cleaned),
M: Moderate (30% to 90% of substrate surface was cleaned), and
P: Poor (less than 30% of substrate surface was cleaned).

As shown in Table 5, in the cases where the thickness of the object-to-be-removed is 5.00 μm or less, the object-to-be-removed was removed from approximately whole area of molding surface. On the other hand, in the case where the thickness of the object-to-be-removed is 10.00 μm, the object-to-be-removed could hardly be removed. From the above, it was revealed that, in a state where the above equation (1) is materialized and C5≦0.75 is materialized, when the thickness of the object-to-be-removed is 5.00 μm or less, in particular, the article-to-be-cleaned can be effectively cleaned.

The new ultrasonic cleaning action in accordance with the present embodiment, which is different from the conventional ultrasonic cleaning action described in the Background Art section, as well as the new bubble cleaning action in accordance with the present embodiment, which is different from the conventional bubble cleaning action described in the Background Art section will be described below in detail.

(New Ultrasonic Cleaning Action)

Figure 8:
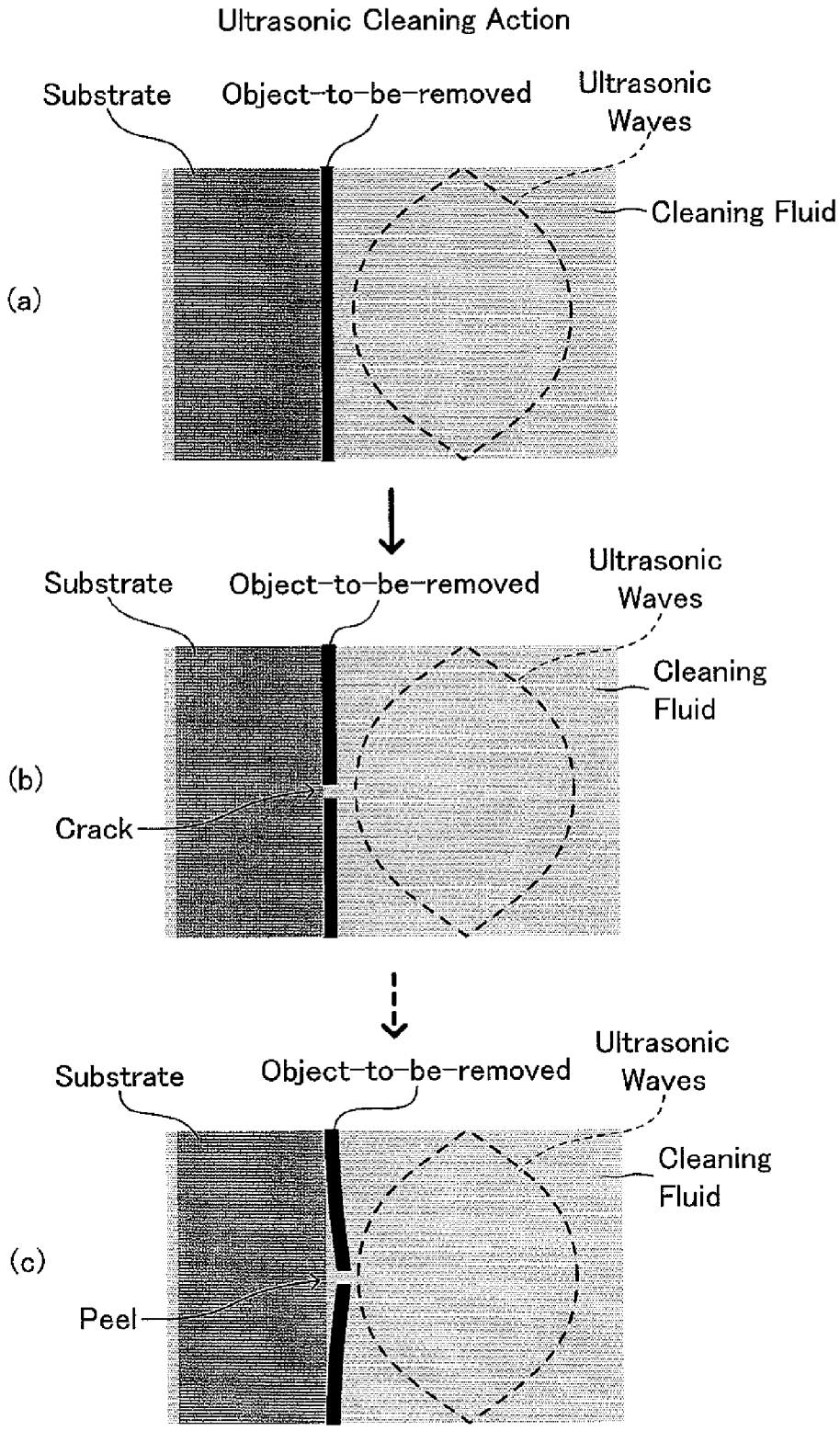
FIG. 8 is a view, explaining the ultrasonic cleaning action.

As shown in FIG. 8 (*a*), it is supposed that a thin object-to-be-removed is adhering to the surface of a substrate. In this case, when vibration energy due to ultrasonic waves is imparted, as shown in FIG. 8 (*b*), a crack can be formed in the object-to-be-removed. This action is referred to as a "new ultrasonic cleaning action". When the object-to-be-removed has a small thickness of 5.00 μm or less, a crack is likely to be generated in the object-to-be-removed. Accordingly, even though the amplitude of ultrasonic waves is small as in this embodiment, a crack can be securely formed in the object-to-be-removed.

Once a crack is formed in the object-to-be-removed by the new ultrasonic cleaning action, as shown in FIG. 8 (*c*), at this crack as a starting point, an action releasing the object-to-be-removed from the substrate may be generated through the vibration energy of ultrasonic waves itself (i.e., the pressure fluctuation itself in the cleaning fluid). Thus, in some cases, only by means of an ultrasonic cleaning action, a substrate can be cleaned, and an object-to-be-removed can be securely peeled from the substrate.

(New Bubble Cleaning Action)

Figure 9:
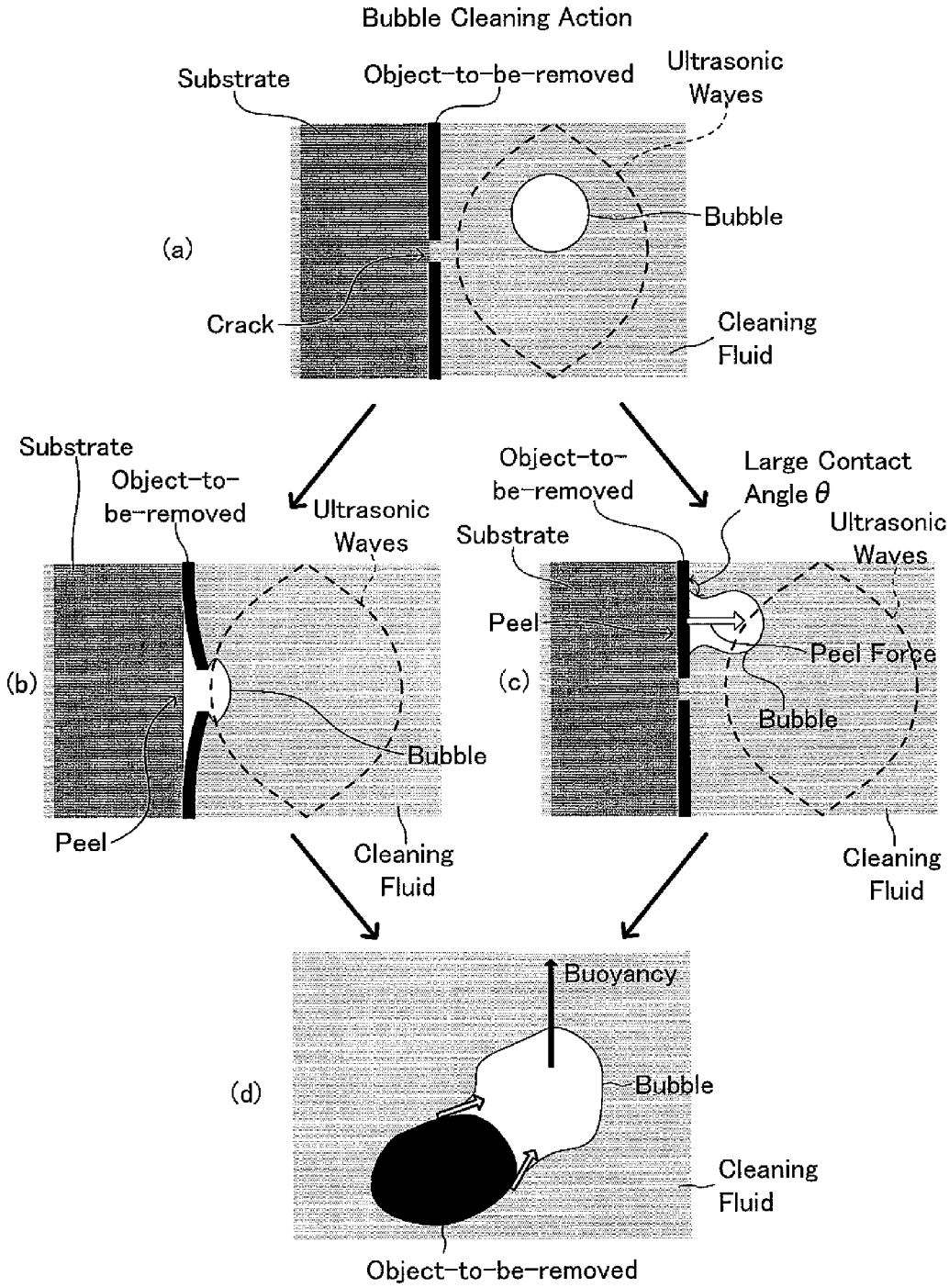
FIG. 9 is a view, explaining the bubble cleaning action.

As shown in FIG. 9 (*a*), it is supposed that a crack has been formed in a thin object-to-be-removed adhering to the surface of a substrate. This crack may have been formed by the new ultrasonic cleaning action, or for other reason.

As shown in FIG. 9 (*b*), once a bubble intrude into the boundary between the object-to-be-removed and the substrate through the crack in the object-to-be-removed, the adherence of the object-to-be-removed to the substrate decreases and an action releasing the object-to-be-removed from the substrate.

Further, in the case where the wettability of the cleaning fluid to the object-to-be-removed is sufficiently low (e.g., in the case where the contact angle (refer to the contact angle θ in FIG. 9 (*c*)) between the object-to-be-removed and the cleaning fluid is 90° or more), such as the case where "water" having a large surface tension of 70 mN/m or more is used as the cleaning fluid and a fluorocarbon is used as the object-to-be-removed, the arrangement of the object-to-be-removed and the cleaning fluid and the bubble (i.e., three phases) is determined mainly due to the large surface tension of the cleaning fluid to the boundary between the object-to-be-removed and the cleaning fluid. As a result, as shown in FIG. 9 (*c*), the bubble becomes likely to adhere to the object-to-be-removed, and a state where the object-to-be-removed and the cleaning fluid and the bubble (i.e., three phases) contact with one another can occur.

In this state, the bubble becomes ready to move through the action on the bubble by a force in a direction getting away from the substrate due to the action of buoyancy or the like on the bubble. This force acts in a direction increasing the area of the interface between the object-to-be-removed and the cleaning fluid. At this time, due to the above-described "the large surface tension of the cleaning fluid to the boundary between the object-to-be-removed and the cleaning fluid", a force in a direction following the moving direction of the bubble acts on the object-to-be-removed such that the increase of the area of the interface is inhibited. This force functions as a peel force releasing the object-to-be-removed from the substrate (refer to the white arrow in FIG. 9 (*c*)), and the action releasing the object-to-be-removed from the substrate is generated due to this peel force.

Even after the object-to-be-removed was peeled from the substrate by the action shown in FIG. 9 (*b*) or FIG. 9 (*c*), as shown in FIG. 9 (*d*), based on the same principle as the principle shown in FIG. 9 (*c*), the above-described "force in a direction following the moving direction of the bubble" still continues to act on the object-to-be-removed (refer to the white arrow in the figure). Accordingly, following the bubble rising toward the surface by buoyancy, the object-to-be-removed also rises toward the surface while keeping in touch with the bubble.

Thereby, the object-to-be-removed after being peeled from the substrate rises to the surface of the fluid (water), and is easily recovered by filtered through the Filter 12 together with the overflowed cleaning fluid. Therefore, the cleaning fluid in the First Compartment R1 is unlikely to be contaminated with the object-to-be-removed. Also, in some cases, the recovered object-to-be-removed can be reused.

Thus, the action, which peels the object-to-be-removed from the substrate by the action shown in FIG. 9 (*b*) or FIG. 9 (*c*), make the object-to-be-removed rise to the surface along with the bubble as shown in FIG. 9 (*d*), and remove the object-to-be-removed, is referred to as a "new bubble cleaning action". Thus, by the new bubble cleaning action, an object-to-be-removed can be peeled from an article-to-be-cleaned at a crack as a starting point, and can be removed.

As the above, in the above-described embodiment, the new ultrasonic cleaning action can form a crack mainly in an object-to-be-removed, and the new bubble cleaning action can peel the object-to-be-removed from an article-to-be-cleaned at the crack as a starting point, and can remove the object-to-be-removed. In the above-described embodiment, since the new ultrasonic cleaning action and the new bubble cleaning action can concurrently function, a flow from "formation of a crack" to "peeling and removal of an object-to-be-removed at a crack as a starting point" can be smoothly formed. As a result, a substrate, which is an article-to-be-cleaned, can be effectively cleaned as compared with a case where the ultrasonic cleaning action functions by itself, or a case where the bubble cleaning action functions by itself.

The above-described new bubble cleaning action functions even when the bubble diameter is larger than 100 μm. However, as the bubble diameter increases, the rising rate to the surface of the bubble increases. Thereby, since it becomes difficult for the bubble to stay in a cleaning fluid, it becomes difficult to sufficiently obtain the new bubble cleaning action. To the contrary, as in this embodiment, when the bubble has a small diameter of less than 100 μm, the possibility for the bubbles to adhere to an object-to-be-removed becomes high, and, as a result, the new bubble cleaning action functions effectively.

Further, in a case where the wettability of a cleaning fluid to an object-to-be-removed is high (specifically, in the case where the contact angle of a cleaning to an object-to-be-removed is 90° or less), such as when an object-to-be-removed consists of a material other than fluorocarbons, or when a liquid with a low surface tension is used as a cleaning fluid, it becomes difficult for bubbles to adhere to the object-to-be-removed, and as a result the new bubble cleaning action does not function sufficiently. However, the conventional bubble cleaning action (specifically, an adhesion of oily content to the surface of bubble, or the like) can function.

An ultrasonic cleaning method (ultrasonic cleaning apparatus) according to an embodiment of the present invention was described above. However, the present invention is not limited to the above embodiments, and various modification can be adopted within the scope of the present invention. For example, although ultrasonic waves are continuously irradiated in the above embodiment, ultrasonic waves may be intermittently irradiated.

Figure 10:
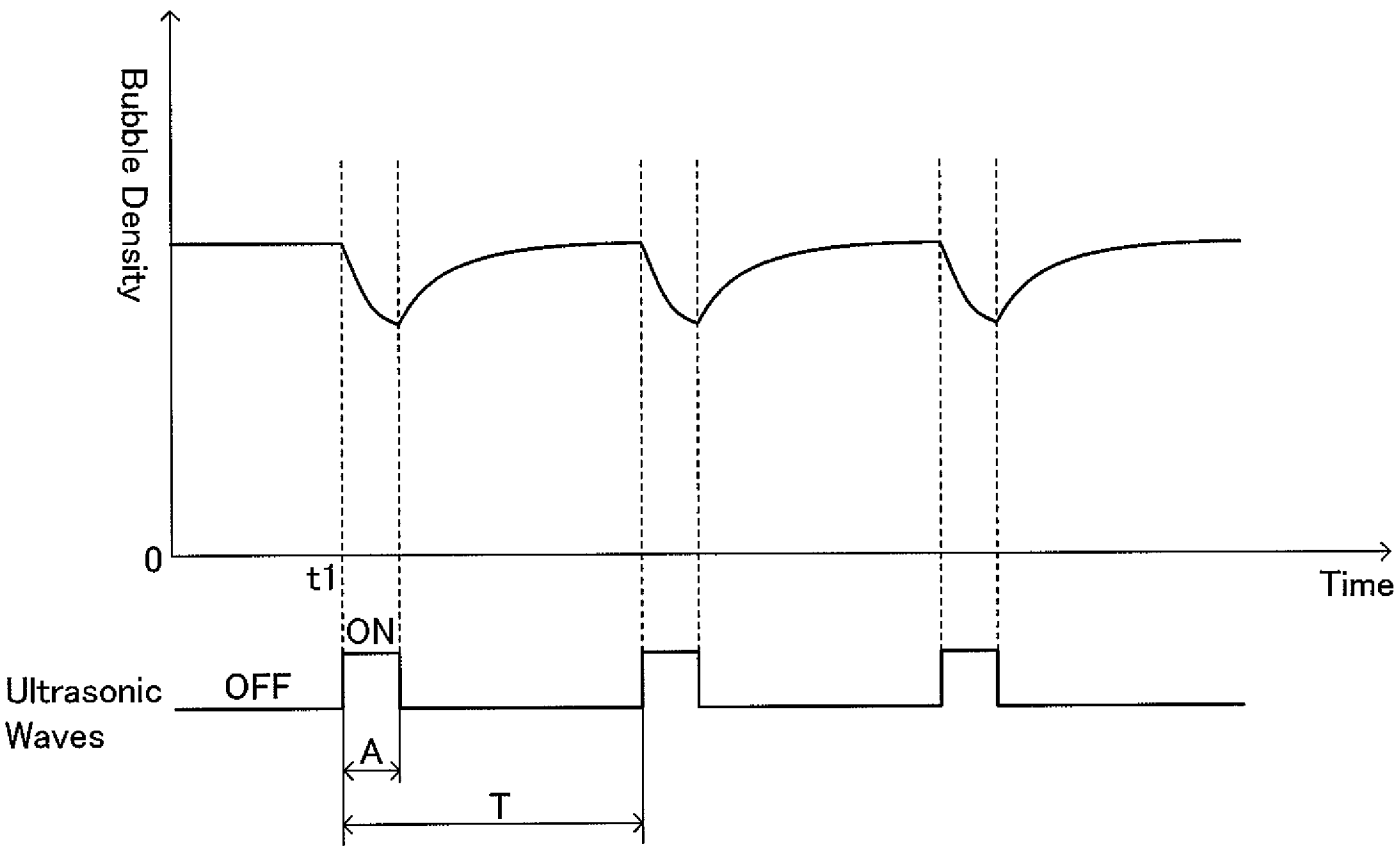
FIG. 10 is a view, showing an example of the transition of the number of bubbles in a cleaning fluid when ultrasonic waves are intermittently irradiated in accordance with the present invention.

In this case, as shown after the time t1 in FIG. 10, it is preferred that ultrasonic waves are periodically irradiated. Specifically, as an example of the irradiation patterns of ultrasonic waves, for example, a pattern where a cycle T is 1 second, and the irradiation period A of ultrasonic waves per one cycle is 0.2 second can be adopted.

Thus, by intermittently irradiating ultrasonic waves, the disappearance of bubbles through the above-described coalition and crush of bubbles due to the irradiation of ultrasonic waves also occurs intermittently. Thereby, as compared with a case where ultrasonic waves are continuously irradiated, the number of bubbles in a cleaning fluid (bubble density)

becomes more unlikely to decrease, and the new bubble cleaning action functions more effectively.

In particular, as shown in FIG. 10, in a case where the irradiation pattern of ultrasonic waves and the discharge condition of a gas-mixed cleaning fluid by a pump in the Bubble Supply Apparatus 20 are adjusted such that the bubble density in the cleaning fluid is maintained approximately constant at every time a cycle of the irradiation pattern of ultrasonic waves passes, the bubble density in the cleaning fluid does not gradually decrease at every time a cycle passes. Therefore, it is possible to elongate the period, during which the new ultrasonic cleaning action and the new bubble cleaning action can concurrently function.

Also, in the above-described embodiment, as a cleaning fluid, a liquid with a surfactant added thereto may be used. When a surfactant is added to a cleaning fluid, the coalition of bubbles is suppressed, and a diameter of bubbles is reduced. This will be described below.

<Suppressing Coalition>

Figure 11:
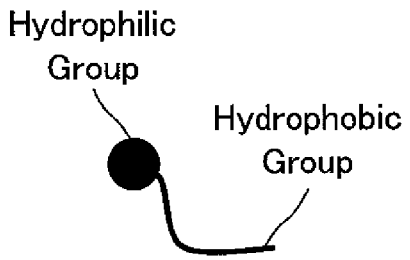
FIG. 11 is a schematic view, showing one molecule of a surfactant.
Figure 12:
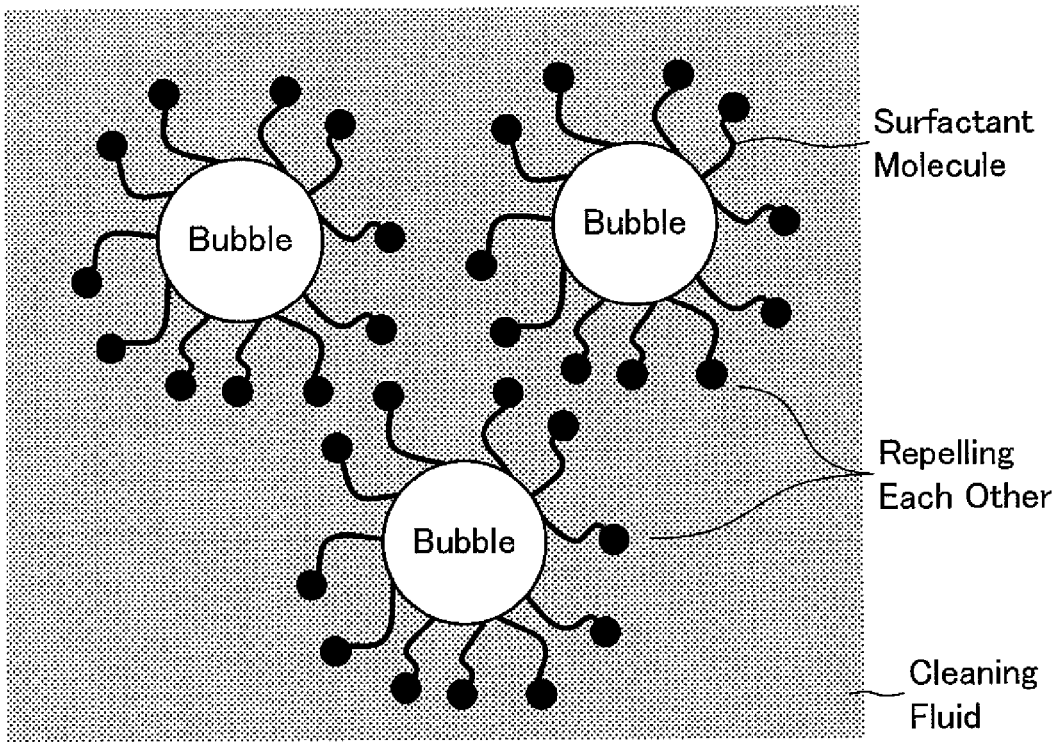
FIG. 12 is a view, explaining that the coalescence of bubbles in a cleaning fluid is suppressed by adding surfactant to a cleaning fluid.
Figure 13:
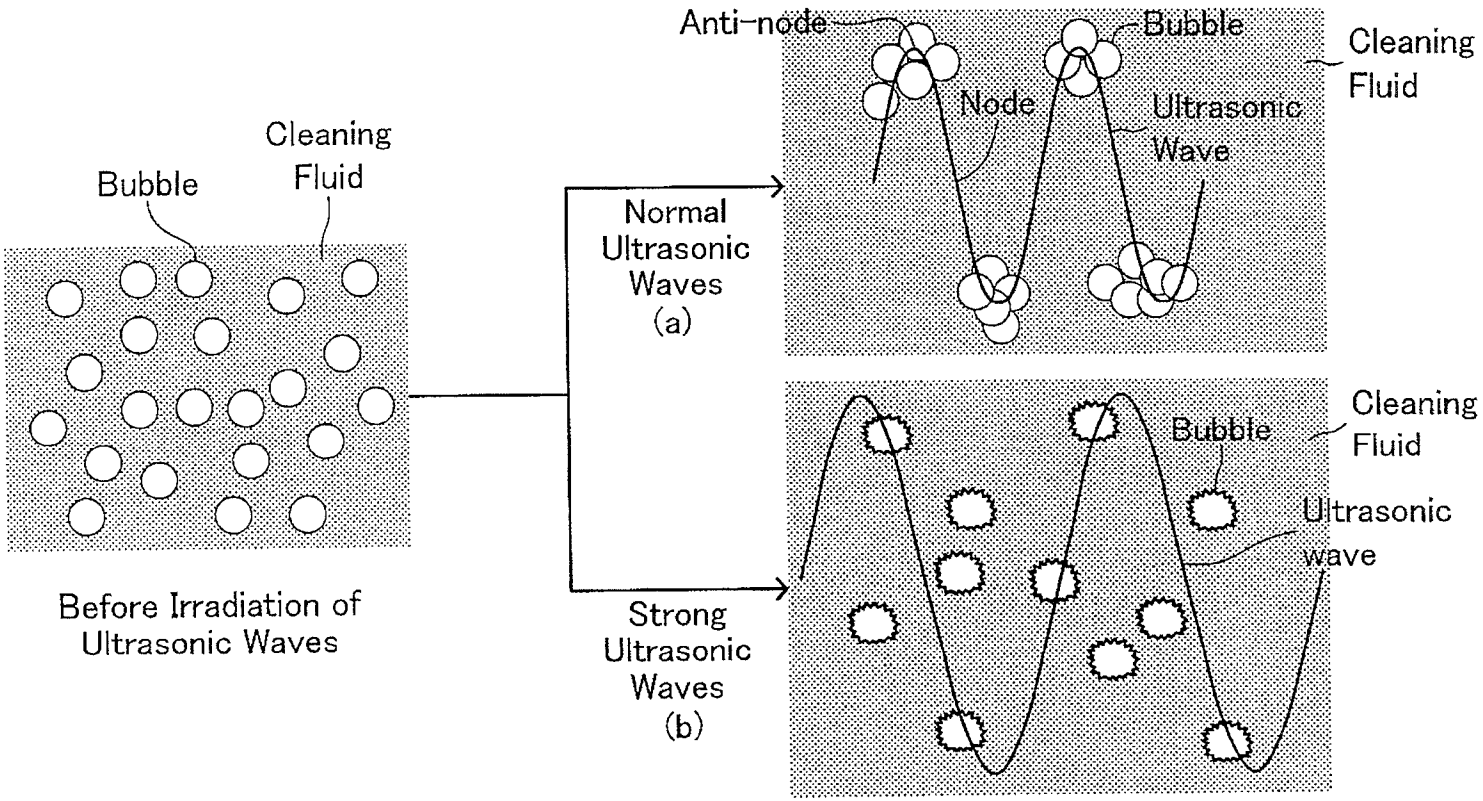
FIG.13 PRIOR ART
FIG. 13 is a view, explaining a conventional pattern of the irradiation of ultrasonic waves.

As shown in FIG. 11, each molecule of a surfactant has a hydrophilic group and a hydrophobic group. When a surfactant is added into a cleaning fluid in which bubbles exist, an action moving the hydrophobic group of the surfactant to a position where the cleaning fluid (water) does not exist functions. As a result, as shown in FIG. 12, the hydrophobic groups of the surfactant molecules aggregate at the surface of each bubble. Thereby, each bubble is in a state where the periphery surface thereof is covered with the hydrophilic groups of the surfactant. Then, since the hydrophilic groups have the same type of charge as one another, they repel one another. As a result, since bubbles repel one another, the above-described aggregation and coalition of bubbles are suppressed.

<Reducing Bubble Diameter>

In general, for a bubble with a stable diameter, the following equation (2) is materialized. The equation (2) is referred to as the Young-Laplace equation. In the equation (2), ΔP is a differential pressure between the inside and the outside of a bubble, γ is the surface tension of a liquid (cleaning fluid), and d is the diameter of a bubble.

$$\Delta P=(4\cdot\gamma)/d \quad (2)$$

Surfactant brings out an action decreasing the surface tension of the liquid (cleaning fluid) to which the surfactant is added. Accordingly, when the surface tension of a cleaning fluid by adding a surfactant thereto under the same pressure condition ΔP, the diameter of a bubble becomes smaller.

As the above, when a surfactant is added to a cleaning fluid, the coalition of bubbles is suppressed and the diameters of bubbles are reduced. This means that the initial number of bubbles in the cleaning fluid (bubble density) increases. As a result, the possibility for bubbles to adhere to an object-to-be-removed becomes high, and the new bubble cleaning action functions more effectively. Also, when a surfactant is added to a cleaning fluid, the new bubble cleaning action through each bubble decreases due to the decrease in the surface tension of the cleaning fluid. However, it is believed that, in some cases, the increase in the number of bubbles raises the possibility for bubbles to adhere to an object-to-be-removed, and thereby the new bubble cleaning action functions more effectively as described above.

What is claimed is:

1. An ultrasonic cleaning method using an ultrasonic wave irradiation means for irradiating ultrasonic waves to a cleaning fluid retained in a cleaning bath, and a bubble supply means for supplying bubbles to said retained cleaning fluid, the method comprising:

cleaning an article-to-be-cleaned immersed in said retained cleaning fluid by irradiating ultrasonic waves to said retained cleaning fluid by means of said ultrasonic wave irradiation means in a state where bubbles exist in said retained cleaning fluid by virtue of the operation of said bubble supply means, wherein the bubble supply means supplies bubbles to the retained cleaning fluid by circulating the retained cleaning fluid through a pump and mixing a gas into the cleaning fluid discharged from the pump;

controlling an operation of said ultrasonic wave irradiation means by adjusting a combination of frequency and power to the ultrasonic wave irradiation means so as to materialize the relation represented by the following equation:

$$0.04f-20.0\leqq P\leqq 0.09f-7.5$$

where f (unit: kHz) is the frequency of the ultrasonic waves irradiated by said ultrasonic wave irradiation means, and P (unit: W/L) is the power per unit fluid volume obtained by dividing the power (unit: W) of the ultrasonic waves irradiated by said ultrasonic wave irradiation means by the volume (unit: L) of said retained cleaning fluid; and controlling the operation of said bubble supply means by adjusting a circulation flow rate of the cleaning fluid and a mixing flow rate of the gas so that a proportion of a brightness value of the cleaning fluid is 0.75 or less wherein the brightness value is determined by processing photographic images of the cleaning fluid to determine the proportion of the brightness value of the cleaning fluid after 5 seconds has passed since both said ultrasonic wave irradiation means and said bubble supply means are concurrently operating to a brightness value of the cleaning fluid when no bubbles exist in said retained cleaning fluid.

2. An ultrasonic cleaning method according to claim 1, wherein said ultrasonic wave irradiation means and said bubble supply means start their operation at the same time, or one of said ultrasonic wave irradiation means and said bubble supply means starts its operation first and the other starts its operation afterwards.

3. An ultrasonic cleaning method according to claim 1, wherein ultrasonic waves are intermittently irradiated by said ultrasonic wave irradiation means.

4. An ultrasonic cleaning method according to claim 1, wherein, as said cleaning fluid, a liquid with a surfactant added thereto is used.

5. An ultrasonic cleaning method according to claim 1, wherein the average diameter of said bubbles is 100 μm or less.

6. An ultrasonic cleaning method according to claim 1, wherein, as said cleaning fluid, a liquid with a surface tension of 30 mN/m or more is used.

7. An ultrasonic cleaning method according to claim 1, wherein the contact angle between said object-to-be-removed adhering to the surface of said article-to-be-cleaned, which is a target to be removed by said cleaning, and said cleaning fluid and said bubbles supplied by said bubble supply means is 90 degrees or more.

8. An ultrasonic cleaning method according to claim 7, wherein said object-to-be-removed is a fluorocarbon.

9. An ultrasonic cleaning method according to claim 1, wherein the thickness of said object-to-be-removed adhering to the surface of said article-to-be-cleaned, which is a target to be removed by said cleaning, is 5.00 μm or less.

* * * * *